United States Patent [19]

Brown

[11] 4,324,191

[45] Apr. 13, 1982

[54] AUXILIARY SEWING MACHINE MOTOR BRAKING

[75] Inventor: Jack Brown, Union, N.J.

[73] Assignee: The Singer Company, Stamford, Conn.

[21] Appl. No.: 271,446

[22] Filed: Jun. 8, 1981

[51] Int. Cl.[3] ..... D05B 69/22; D05B 3/02

[52] U.S. Cl. ..... 112/277; 112/158 E

[58] Field of Search ..... 112/277, 275, 158 E, 112/158 B, 67

[56] References Cited

U.S. PATENT DOCUMENTS 3,987,739 10/1976 Wurst et al. ..... 112/158 E 4,159,688 7/1979 Garron et al. ..... 112/158 B X 4,243,919 1/1981 Brown ..... 112/158 E

*Primary Examiner*—Peter P. Nerbun

*Attorney, Agent, or Firm*—Edward P. Schmidt; Robert E. Smith; Edward L. Bell

[57] ABSTRACT

An auxiliary fast stop braking circuit is provided for an electronically controlled sewing machine having the capability to implement a single pattern of a repetitive stitch pattern by implementing needle bar release from its drive means and zero feed motion at the completion of the last stitch of the pattern. The auxiliary fast stop braking circuit is responsive to selection of a single pattern and to activation of the needle bar release solenoid to implement dynamic braking of the sewing machine motor.

3 Claims, 4 Drawing Figures

AUXILIARY SEWING MACHINE MOTOR BRAKING

DESCRIPTION

BACKGROUND OF THE INVENTION

This invention is in the field of sewing machines; more particularly, it is concerned with a means for initiating fast stop braking after the completion of a single pattern or of a one step buttonhole operation.

In a prior art electronically controlled sewing machine having single pattern capability, and also having a capability to implement a buttonhole in one step, at the completion of the single pattern, or buttonhole, a needle bar release device is activated to suspend needle bar reciprocation and the feed system is nulled to obtain zero feed. However, the sewing machine motor continues to run and at an increased speed due to the decreased loading thereon as a result primarily of no further work material feeding. This apparent increased activity of the sewing machine at a time when cessation of activity is expected is disconcerting and gives a perception of a faulty machine.

What is required is a means for stopping the motor under these conditions which is economical and simple of design and which is readily adaptable to a wide range of electronically controlled sewing machines.

SUMMARY OF THE INVENTION

The above requirement has been attained in an electronically controlled sewing machine having an arm shaft position sensor arranged to signal by a change of state the release of feed data from an LSI logic, or to signal by a second change of state the release of bight data from the LSI logic. A motor braking arrangement is utilized similar to that disclosed in the U.S. Pat. No. 4,243,919, issued on Jan. 6, 1981 to Brown.

Fast stop braking may be initiated for certain functions of an electronically controlled sewing machine such as single patern implementation disclosed in U.S. Pat. No. 3,987,739, Oct. 26, 1976 of Wurst et al. There is also U.S. Pat. No. 4,159,688, issued on July 3, 1979 to Garron et al, which patent disclosed a method for implementing a buttonhole in an electronically controlled machine. Circuitry is disclosed for initiating implementation of the motor braking arrangement disclosed in the above patent, when a single pattern is completed, or at the completion of a buttonhole pattern, so as to prevent sewing machine coast and additional work material penetration or stitching. An auxiliary fast stop braking circuit is provided for regulating the motor braking arrangement subject to certain signals indicative of the completion of a single pattern or of a buttonhole, such as a signal to suspend needle bar reciprocation. Provision is made to maintain the auxiliary fast stop braking circuit disabled during normal sewing machine operation.

The invention accordingly comprises the constructions hereinafter described, the scope of the invention being indicated in the following claims.

DESCRIPTION OF THE DRAWINGS

In the accompanying drawings:

Referring now to FIG. 1 there is shown a sewing machine 10 including a bed 12 with a standard 14 rising from one end thereof. The standard 14 supports a bracket arm 16 overhanging the bed 12, the bracket arm terminating in a head end 18. Within the head end 18 there is supported a presser bar 20 having a presser foot 21 supported on the end thereof. The presser foot 21 is urged by the presser bar 20 against the bed 12 for cooperation with feed dogs 22, part of a feed system (not shown) supported in the bed, all as is well known in the sewing machine art. The head end 18 also supports therein a needle bar 24 supporting a sewing needle 25 in the end thereof, the needle bar being supported in a gate arrangement as is disclosed in the U.S. Pat. No. 3,872,809, issued on Mar. 25, 1975 to the assignee of record, which patent is hereby incorporated by reference herein. By way of explanation the needle bar gate arrangement includes a needle bar release device having a latch release member that is movable by a solenoid into engagement with a coupling member to unlatch the coupling member from a needle bar drive member. The device also includes biasing springs for elevating the needle bar 24 to an uppermost position upon unlatching of the coupling member from the needle bar drive member.

Figure 1:
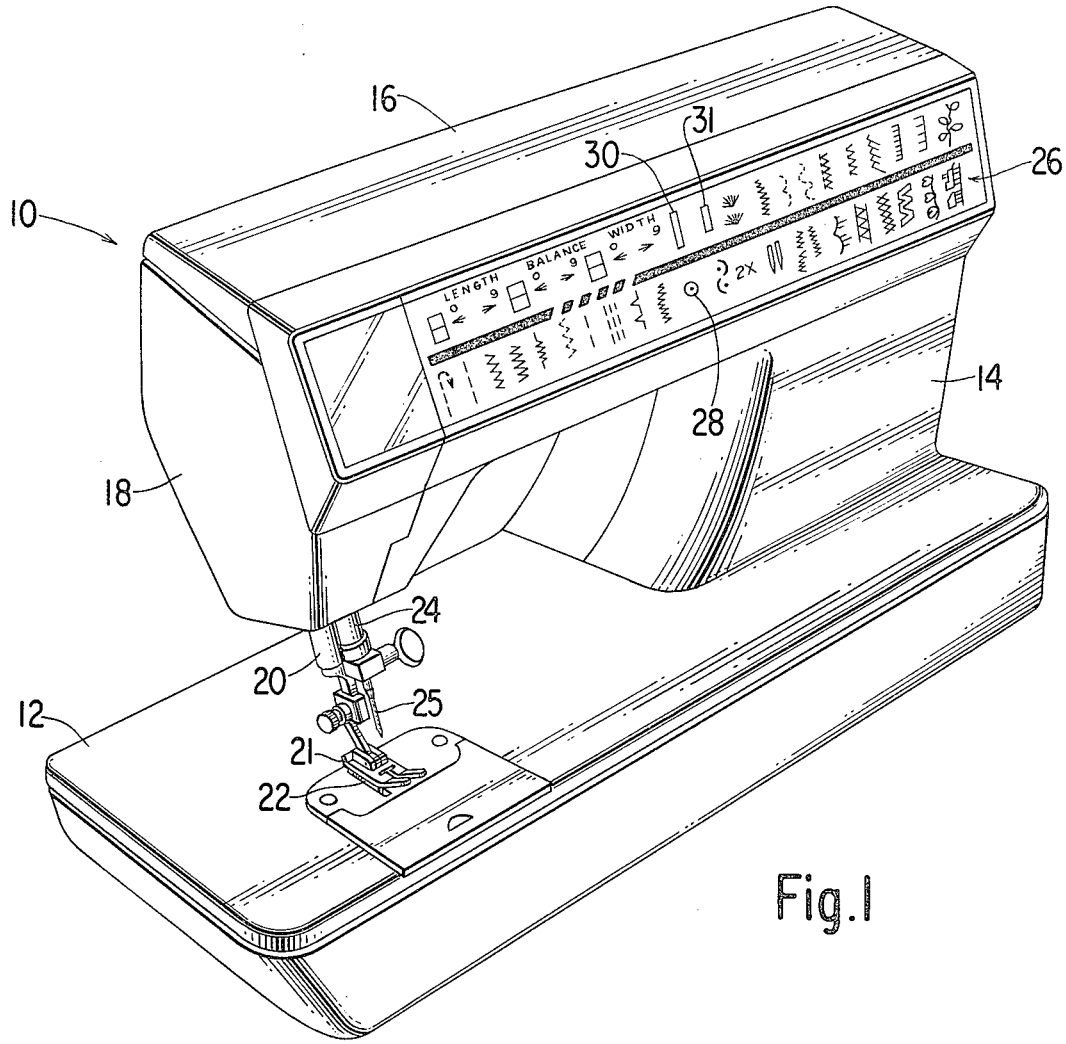
FIG. 1 is a perspective view of a sewing machine incorporating the present invention.

The sewing machine 10 further includes within the bracket arm 16 capability for electronically controlling the lateral position of the sewing needle 25 and the feeding rate implemented by the feed dogs 22. Capability for several ornamental patterns is retained in a solid state memory which is part of the circuitry within the bracket arm 16, which circuitry further includes logic for determining, and implementing a selection from among the various capabilities displayed in the selection board 26 on the forward side of the bracket arm. Among the selection capabilities presented by the selection board 26 is a single pattern capability represented by the single pattern insignia 28. Such capability is described in the U.S. Pat. No. 3,987,739, issued on Oct. 26, 1976 to Wurst et al and owned by the assignee of record, which patent is hereby incorporated by reference herein. In that patent there is disclosed a means by which an operator may limit the operation of the sewing machine to stitching of a single execution of any selected stitch pattern. After the stitching of a single pattern has been completed, further operation of the sewing machine is inhibited by suspension of needle reciprocation, needle jogging and work feeding motion.

Also disclosed on the selection board 26 are the insignia for large buttonhole 30 and small buttonhole 31. Selection of a buttonhole insignia 30, 31 automatically selects the single pattern capability without selection of the single pattern insignia 28. The selection board 26 operates as is disclosed in U.S. Pat. No. 4,242,667, issued on Dec. 30, 1980 to Hunts, which patent is owned by the assignee of the instant invention and is incorporated by reference herein. This patent discloses the use of proximity switch pairs so as to obtain a high density arrangement. Thus, each insignia in the selection board 26 is responsive to the touch of an operator's finger to actuate a pair of proximity elements which are unique for each insignia. The selection of proximity elements is decoded in a decoder, the output of which communicates with the other electronic elements within the bracket arm 16 to produce a selected result.

Figure 2B:
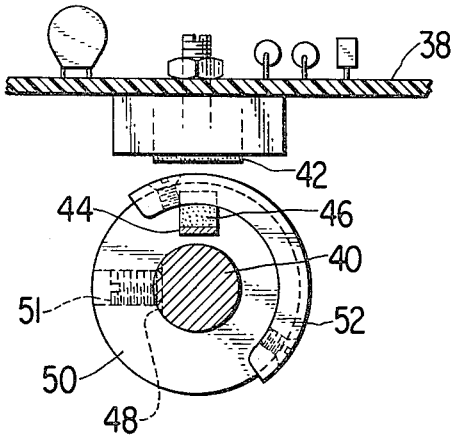
FIG. 2*b* is a cross sectional view of the arm shaft position sensor taken substantially along the line 2*b*—2*b* in FIG. 2*a;* and, FIG. 3 is a circuit diagram which may be utilized to control the sewing machine of FIG. 1 in order to attain the improvements of the invention.
Figure 2A:
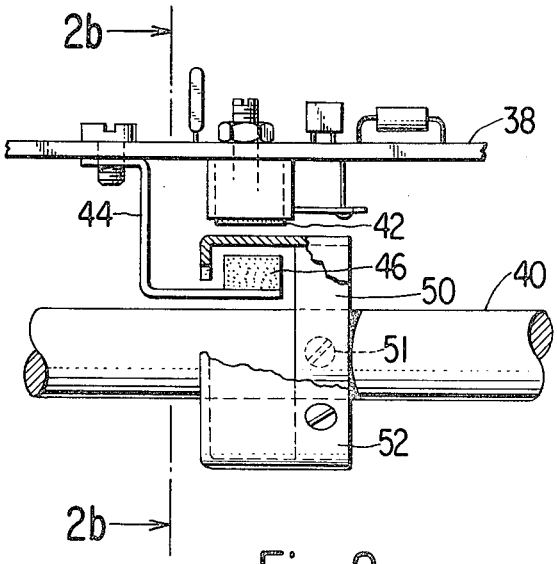
FIG. 2*a* is a frontal view of an arm shaft position sensor utilized in the sewing machine shown in FIG. 1.

Referring now to FIGS. 2*a* and 2*b* there is shown an electronic circuit board 38, part of the electronic circuitry retained in the bracket arm 16. The circuit board 38 and the components supported thereon are supported in the bracket arm 16 adjacent the horizontal arm shaft 40 for the sewing machine. As is well known in the sewing machine art the horizontal arm shaft 40 revolves once for each penetration of the work material by the sewing needle 25. Supported on the circuit board 38 and extending therefrom towards the horizontal arm shaft 40 is a Hall effect device 42. A small bracket 44 is attached to the circuit board 38 adjacent the Hall effect device 42, the bracket being formed to extend around the Hall effect device and support a magnet 46 adjacent the Hall effect device. The horizontal arm shaft 40 is provided with a flat 48 thereon for receiving a set screw 51 extending through a collar 50. The collar 50 supports a shield 52 which extends between the magnet 46 and Hall effect device 42 for approximately 180° of the rotation of the horizontal arm shaft 40. The shielding of the Hall effect device 42 from the magnet 46 for approximately 180° is apparent from FIG. 2*b* which shows the relationship of the shield 52 to the Hall effect device and magnet. The result of this relationship is that the magnetic field from the magnet 46 is diverted by the shield 52 for approximately 180° of rotation of the arm shaft 40. By positioning of the flat 48 on the horizontal arm shaft 40 the shield 52 is arranged so that the Hall effect device 42 is in one state from substantially a needle up position to a needle down position, and in a second state from substantially a needle down position to the needle up position. The Hall effect device 42 and magnet 46 constitute and will be referred to as an arm shaft position sensor 45. The change of state of the Hall effect device 42 at needle up or needle down position, is utilized to indicate a release of bight information or of feed information from the electronic devices retained in the bracket arm 16. For more information on the operation of a similar form of arm shaft position sensor 45, the reader is referred to the U.S. Pat. No. 3,939,372, issued on Feb. 19, 1976 to the assignee of record, which patent is hereby incorporated by reference herein.

Figure 3:
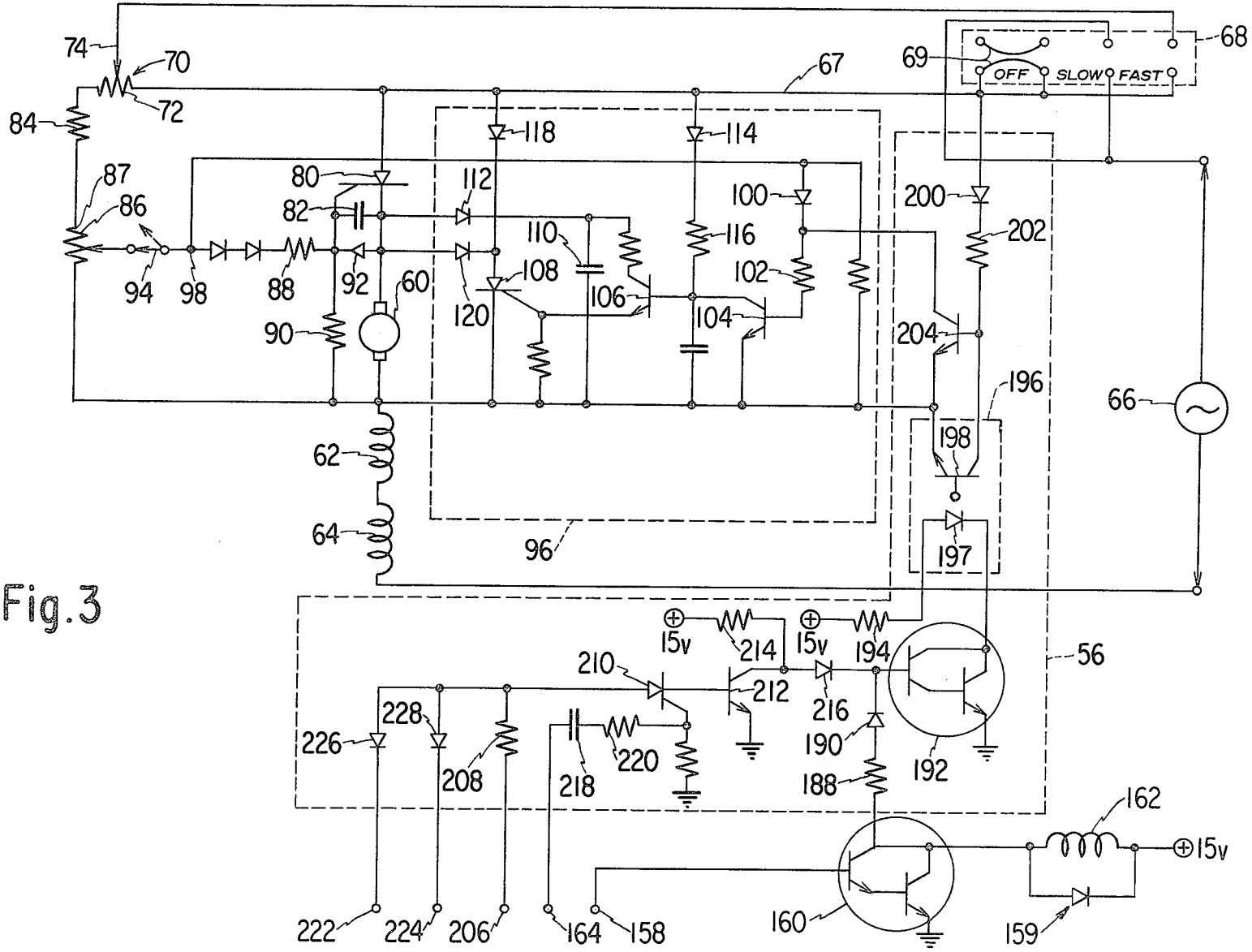

In FIG. 3 there is shown an electronic circuit diagram for powering an SCR motor of a sewing machine, which circuit may be included with the other circuits retained in the bracket arm 16 of the sewing machine. The circuit diagram of FIG. 3 includes as part thereof, the motor braking arrangement disclosed in the commonly owned U.S. Pat. No. 4,243,919, issued on Jan. 6, 1981 to Brown which is hereby incorporated by reference herein. In that patent, there is disclosed an SCR motor speed control system having provision therein for fast braking of the motor. A circuitry senses when it is desired to stop the motor and simultaneously short circuits the motor armature and applies halfwave rectified line voltage to the motor field windings. To the circuitry disclosed in the above referenced patent, there has been applied an auxiliary fast stop circuit enclosed by the dotted line 56 in FIG. 3. Externally of the dotted lines are shown the inputs from an LSI (large scale integrated circuit) comprising a solid state memory and logic devices regulating the operation of the sewing machine, part of the electronic devices retained within the bracket arm 16 of the sewing machine 10. There is also disclosed a circuit to implement the needle bar release i.e., for actuating the device of the U.S. Pat. No. 3,872,809 of Adams et al referred to above.

Referring to FIG. 3, there is shown a circuit including the capability for controlling the speed of a motor having an armature winding 60 and field windings 62 and 64, as disclosed in the above referenced patent. These motor windings are serially connected to an alternating power supply 66 through a speed range selector switch 68. The power supply 66 may be a commercially available 115 volt 60 hertz power. The selector switch 68 permits the selection of a slow speed range which operates through the entire resistance 72 of a potentiometer 70, or with the slider 69 in the fast position, a portion of the resistance 72 may be bypassed by the wiper 74. In either event, the motor braking arrangement and a silicon controlled rectifier (SCR) 80 are supplied with the full output of the power supply 66.

The SCR 80, armature windings 60 and field windings 62, 64 are connected directly across power supply 66. When the SCR 80 is triggered into conduction, current from the power supply 66 flows through the armature winding 60 and field windings 62, 64. To trigger the SCR 80, there is supplied a firing circuit which includes the charging capacitor 82 and current controlling circuit comprising the resistors 84, 86, 88 and 90. Within a positive half cycle from the power supply 66 the capacitor 82 is charged to the threshold value for the SCR 80, at which point the SCR begins to conduct and the motor begins to operate. Motor speed is controlled by varying the position of the wiper on the potentiometer 86, the closer that wiper is to the point 87 the less the resistance in the charging circuit and the faster the capacitor charges. The motor therefore will run faster since more of the positive half cycle of power is flowing through the SCR 80. Conversely, the further that the wiper is from the point 87, the greater the charging half resistance and the slower the charging rate of the capacitor 82. The motor will run slower. During negative half cycles of the power supply 66, the capacitor 82 discharges through the gate cathode path of the SCR 80 and through the resistor 90 and the armature winding 60. The diode 92 prevents excessive reverse voltage from appearing across the cathode gate of the SCR 80.

As used in the sewing machine, the potentiometer 86 is carried within a foot controller which causes the wiper therein to be moved from the furthest extreme of the potentiometer towards the point 87. The foot controller additionally carries a switch 94 which is in the open position until an operator's foot depresses the foot controller whereupon the switch is closed. In a sewing machine it is desirable that the sewing motor thereof come to a stop quickly when pressure is removed from a foot controller in order to avoid any further stitches which are not desired. To accommodate this desire, a braking circuit is shown within the dotted line 96 which was subject of the above referenced U.S. Patent on Motor Braking Arrangement. With the foot controller depressed, i.e., with the wiper of the potentiometer 86 displaced towards the point 87, a voltage at point 96 causes current to flow through the diode 100 and resistor 102 into the base of the transistor 104, causing conduction thereof. When the transistor 104 conducts, current is diverted from the base of transistor 106 thereby not permitting transistor 106 to conduct current to the gate of SCR 108 so that the SCR 108 does not conduct. Thus, while the motor is running, the armature voltage is used to charge capacitor 110 through the diode 112, capacitor 110 being able to discharge only when the transistor 106 is conducting.

Upon release of the foot controller and an opening of the switch 94, the flow of current through the diode 100 and resistor 102 of the base to the transistor 104 is interrupted, making transistor 104 non-conductive. A positive voltage from the power supply 66 on line 67 will cause current to flow through diode 114 and resistor 116 to the base of transistor 106 making transistor 106 conductive since its base current is no longer diverted by transistor 104. The capacitor 110 is thus discharged through transistor 106 triggering the SCR 108 into conduction so that current flows through the diode 118 and through the SCR 108 to the field windings 62 and 64. At the same time, the armature winding 60 is short circuited through the diode 120 and SCR 108. The simultaneous short circuiting of the armature 60 and application of power to the field windings 62, 64 causes the motor to brake very quickly.

As indicated above, the motor braking arrangement thus far disclosed is set forth in greater detail in U.S. Pat. No. 4,243,919 to which the reader is referred for more complete exposition thereof. To the circuit disclosed in that patent, an auxiliary fast stop circuit enclosed within the dashed line 56, and a needle bar release circuit 159 are added. A signal on pin 158 of the LSI regulating the operation of the sewing machine 10 indicates the need for and initiates activation of the needle bar release circuit 159. A signal on pin 158 of the LSI activates Darlington pair 160 to allow conduction therethrough to ground from the plus 15 volt source through the needle bar release solenoid 162. Activation of the needle bar release solenoid 162, as explained previously in the referenced U.S. Pat. No. 3,872,809, disengages the needle bar endwise reciprocatory drive from the needle bar to suspend formation of stitches. If the Darlington pair 160 is not activated, current will not flow from the 15 volt source through the needle bar release solenoid 162 to ground. However, a small amount of current will flow from the plus 15 volt source through the needle bar release solenoid 162, through a resistor 188 and diode 190 to the base of a Darlington pair 192. The amount of current passing through the needle bar release solenoid 162 is far too small to cause operation thereof but is sufficient to activate the Darlington pair 192 to cause a current flow from the 15 volt source through a resistor 194 and an input LED 197 of photoisolator 196 to ground. Activation of the input LED 197 causes the output transistor 198 of the photoisolator 196 to conduct. Thus, when the polarity of the voltage on line 67 is positive, current will flow through a diode 200, resistor 202 and through the output transistor 198, diverting current from the base of transistor 204. Transistor 204 will not conduct and will not divert current from the base of transistor 104 which transistor thereby conducts. With transistor 104 conducting, current is diverted from the base of transistor 106 defeating electronic braking of the sewing machine motor. Conversely, if the input LED 197 of the photoisolator 196 is not activated, the output transistor 198 does not conduct and the transistor 204 is made conductive diverting current from the base of transistor 104. Transistor 104, thereby being made non-conductive, allows transistor 106 to be made conductive, thereby initiating, as explained above, braking action. Thus, an auxiliary fast stop braking circuit has been established which is responsive to a photoisolator 196.

Need for the auxiliary fast stop braking circuit capability can be found in the single pattern capability of the sewing machine initiated by selection of a pattern and of the single pattern insignia 28 on the selection board 26. Single pattern control for a sewing machine is disclosed in the commonly owned U.S. Pat. No. 3,987,739, issued on Oct. 26, 1976 to Wurst et al, which is hereby incorporated herein by reference. In that patent, it is disclosed that a single execution of a selected stitch pattern is accomplished after which further operation of the sewing machine is inhibited by suspension of needle reciprocation, needle jogging and work feeding motion. However, operation of the sewing machine motor continues without any stitching taking place, a process which is unnecessary and disconcerting to a sewing machine operator. Accordingly, it is desirable also to cease motor operation when a single pattern has been executed.

When a single pattern selection is made by touching of the single pattern insignia 28 on the selection board 26, the voltage on pin 206 of the LSI changes from negative to positive and remains positive to light a single pattern indicator LED (not shown) which indicates that the single pattern selection has been made. Another connection is made from pin 206 of the LSI through resistor 208 to the anode of SCR 210. No current will flow, however, from anode to cathode of the SCR 210 until the gate thereof is triggered, therefore no current flows into the base of transistor 212. Transistor 212 is non-conductive, so current flows from the plus 15 volt source through the resistor 214 and through diode 216 to the base of Darlington pair 192. As explained above, activation of the Darlington pair 192 permits current to flow from plus 15 volt source through resistor 194 and through the input LED 197 to ground. Activation of the input LED 197 of the photoisolator 196 causes conduction of the output transistor 198 thereof. Thus, current is diverted from the base of transistor 204, disabling the auxiliary fast stop brake circuit.

Further, as explained above, another circuit exists from plus 15 volt source through the needle bar release solenoid 162, through resistor 188 and diode 190 to the base of Darlington pair 192. When the foot controller for the sewing machine is operated to set the sewing machine in motion to implement a single pattern execution, the horizontal arm shaft 40 will rotate, and the arm shaft position sensor 45 will at some time be responsive to a change in position of the horizontal arm shaft to change its output from a negative to a positive voltage. This change in the output of the arm shaft position sensor 45 will cause current to flow momentarily from pin 164 of the LSI, through a capacitor 218 and resistor 220 to the gate of the SCR 210, triggering the SCR into conduction. Trigger current will cease when the capacitor 218 is charged but SCR 210 will continue conducting. Current will now flow from pin 206 of the LSI through resistor 208 and SCR 210 to the base of transistor 212. Transistor 212 will now conduct to ground, diverting current from diode 216. However, current continues to flow from the plus 15 volt source through the needle bar release solenoid 162, resistor 188 and diode 190 to the base of Darlington pair 192 to maintain the Darlington conductive. When a single pattern has been completed, needle reciprocation is suspended by signal from pin 158 of the LSI which activates Darlington pair 160 to cause a current flow from the plus 15 volt source through the needle bar release solenoid 162 to ground. Current is diverted from the base of Darlington pair 192 which ceases to conduct current through the input LED 197 of photoisolator 196. Thereby the output transistor 198 of photoisolator 196 ceases to conduct and the transistor 204 in the auxiliary fast stop braking circuit 56 is enabled causing diversion of current from the base of transistor 104. With the transistor 104 no longer conducting current away from the base of transistor 106, the transistor 106 is thereby made conductive to trigger the SCR 108 and short circuit the armature winding to initiate braking of the sewing machine motor. All the above takes place on a positive cycle of power on line 67. In order to repeat a single pattern, the operator momentarily touches a single pattern insignia 28 on selection board 26, defeating the current flow from pin 158 of the LSI to the Darlington pair 160. Current will once again flow through resistor 188 and diode 190 into the base of Darlington pair 192, allowing the input LED 197 to operate and enable the output transistor 198 of the photoisolator 196. The above recited sequence of operations may thereupon repeat.

Thus, in order to effect motor braking at the end of a single pattern execution, an auxiliary fast stop braking circuit 56 is provided which is disabled by leakage current through a non-utilized needle bar release solenoid 162, and is armed by a selection of the single pattern insignia 28. However, when fast stop braking is armed by actuation of the single pattern insignia 28 by way of a signal on pin 206 of the LSI, and the appropriate signal from the arm shaft position sensor 45 by way of pin 164 of the LSI, the auxiliary fast stop braking circuit 56 is maintained disabled by the leakage current through needle bar release solenoid 162. But when the single pattern is completed, a signal on pin 158 of the LSI activates Darlington pair 160 to permit full current to flow from the plus 15 volt source through the needle bar release solenoid 162 and Darlington to ground, current is thereby diverted from Darlington pair 192 with the consequence that the auxiliary fast stop braking circuit 56 is enabled to implement motor braking through motor braking circuit 96.

There are a number of patterns in other stitching operations used on an electronically controlled machine where current is applied from pin 158 of the LSI to the base of the Darlington pair 160. Such a condition exists, for example, when a sewing machine operator bastes a work material preparatory to final stitching. During such intervals, current ceases to flow through the diode 190 to the base of Darlington pair 192, due to diversion of current to ground by Darlington pair 160, but the auxiliary fast stop braking circuit is kept disabled by current flowing from the plus 15 volt source, through resistor 214 and diode 216 to the base of the Darlington pair 192.

An operation similar to the single pattern operation is encountered when sewing large or small buttonholes selected by way of the large buttonhole insignia 30 or small buttonhole insignia 31 on the selection board 26 of FIG. 1. When a buttonhole pattern is selected, the single pattern mode is automatically engaged, and the voltage on pin 206 of the LSI is always positive. Fast stop braking operates as described for single pattern operation after completion of the first buttonhole pattern. To repeat a buttonhole pattern, however, the operator touches either large buttonhole insignia 30 or small buttonhole insignia 31 which causes the LSI to present a signal on pin 222 or pin 224, respectively, of a negative voltage which is transmitted through diode 226 or 228, respectively, to the anode of SCR 210 cutting off the flow of current thereto and disabling the auxiliary fast stop braking circuit by cutting off the current diversion from the base of Darlington pair 192 by conduction of transistor 212. Thereupon, a single buttonhole pattern may be repeated.

I claim:

1. An auxiliary sewing machine motor braking arrangement for an electronically controlled sewing machine having a frame supporting an endwise reciprocatory and laterally oscillatable needle carrying needle bar, means for selectively suspending endwise reciprocatory motion of said needle bar, a feed system for feeding a work material through said sewing machine at a selected rate in a selected direction, means for selectively nulling feeding of said work material through said sewing machine, means for urging said needle bar to selective lateral positions, means for constraining said feed system to feed work material at a selected rate in a selected direction, means for selectively actuating said needle bar into endwise reciprocatory motion and said feed system into feeding motion, means for electrically braking said actuating means when actuation thereof is not selected, a solid state memory means for retaining digital code words representative of needle stitch position and of feed increment from a previous stitch position of a sequence of stitches for at least one pattern having an identifiable beginning and last stitch, means for selecting implementation of a single pattern terminating in said last stitch, an arm shaft actuated by said actuating means and making one revolution for each endwise reciprocatory movement of said needle bar, an arm shaft position sensing means for timing the release of needle position and feed increment information from said memory to said urging and said constraining means for implementing said stitches to form said pattern, means responsive to selection of said single pattern selecting means and to said last stitch of said at least one pattern for enabling said suspending means and said nulling means, means for detecting the completion of a single pattern, and means responsive to said detecting means for compelling said braking means to brake said actuating means.

2. An auxiliary sewing machine motor braking arrangement as claimed in claim 1 wherein said actuating means comprises a motor having serially connected armature and field windings for operation from a cyclically varying power supply, a phase control circuit connected between said motor and said power supply, a firing circuit coupled to said phase control circuit for phase firing thereof to supply power to said motor for only a portion of the cycle of said power supply when operated; wherein said braking means comprises a controllable switch connected across said armature winding and between the power supply and the field winding, means for closing said controllable switch when operation of said power supply is discontinued, and means for disabling said closing means upon operation of said power supply; wherein said means for selectively suspending endwise reciprocatory motion of said needle bar includes a solenoid activated to disconnect said needle bar from said actuating means; wherein said compelling means comprises circuitry for invalidating said disabling means by diverting current therefrom; and wherein said means for detecting the completion of a single pattern comprises circuitry responsive to current diversion upon activation of said solenoid of said suspending means.

3. An auxiliary sewing machine motor braking arrangement as claimed in claim 2, wherein said controllable switch includes a silicon controlled rectifier; wherein said closing means comprises a capacitor charged during operation of said motor and a second controllable switch for selectively providing a path for the charge from said capacitor to be conducted to the gate of said silicon controlled rectifier; wherein said disabling means comprises a third controllable switch for rendering said second controllable switch non-conductive to defeat said path when said power supply is operated and for rendering said second controllable switch conductive to enable said path when said power supply is not operated; wherein said detecting means further includes a secondary power souce, a fourth controllable switch and a fifth controllable switch closed by said fourth controllable switch on a signal indicative of selection of said single pattern selecting means and from said arm shaft position sensing means so as to divert current from said secondary power source; and, wherein said compelling means comprises a sixth controllable switch for rendering said third controllable switch non-conductive to enable said path when operation of said motor is not desired and for rendering said third controllable switch conductive to defeat said path when operation of said motor is desired, and a seventh controllable switch for rendering said sixth controllable switch non-conductive to defeat said path in response to nonactuation of said suspending means and non-diversion of current by said fifth controllable switch and for rendering said sixth controllable switch conductive to enable said path in response to actuation of said suspending means upon diversion of current by said fifth controllable switch.

* * * * *